United States Patent [19]

Vetter

[11] Patent Number: 4,838,311

[45] Date of Patent: Jun. 13, 1989

[54] CONTROL SYSTEM FOR A PROGRAMMED SPRAYING DEVICE

[75] Inventor: Kurt Vetter, Remseck, Fed. Rep. of Germany

[73] Assignee: Behr Industrieanlagen GmbH & Co., Fed. Rep. of Germany

[21] Appl. No.: 182,853

[22] Filed: Apr. 18, 1988

[30] Foreign Application Priority Data

Apr. 27, 1987 [DE] Fed. Rep. of Germany ..... 3714000

[51] Int. Cl.[4] ..... B05C 5/00

[52] U.S. Cl. ..... 137/624.2; 137/563; 137/569; 239/69

[58] Field of Search ..... 137/624.11, 624.2, 563, 137/569; 239/70, 69, 127

[56] References Cited

U.S. PATENT DOCUMENTS 2,266,354 12/1941 Christensen ..... 137/563 X
4,197,995 4/1980 Campbell ..... 239/127 X
4,362,124 12/1982 Fleig ..... 239/69 X

*Primary Examiner*—Alan Cohan
*Attorney, Agent, or Firm*—Reising, Ethington, Barnard, Perry & Milton

[57] ABSTRACT

In the sequential coating of motor-vehicle bodies using a preprogrammed painter-robot, the paint is switched on and off by an automatically controlled pilot needle-valve (FNV) at predetermined times as a function of the relative positions of the robot and the motor-vehicle body. Return circuits including flow-control valves (DV1, DV2) actuated at predetermined times are provided which match the switching on and off of the pilot needle-valve (FNV) for avoiding unwanted pressure fluctuations.

6 Claims, 3 Drawing Sheets

CONTROL SYSTEM FOR A PROGRAMMED SPRAYING DEVICE

TECHNICAL FIELD

The subject invention relates to a fluid pressure control system for a program-controlled spraying device.

BACKGROUND ART

In the sequential coating of motor vehicle bodies using a program-controlled spraying device, such as a painter-robot, it is an important ability to switch the paint flow on and off when the robot reaches accurately defined positions. The speed at which the robot can travel may amount to 1500 mm/sec. Along a straight section of track to be covered at this speed, it must be possible to switch the flow of paint to the spraying device within an accuracy of 4–5 mm. Therefore, in this flow switching, or paint-transfer, section, there must not be delays in excess of 3 ms. However, this 3 ms tolerance is exceeded in practice. The robot control therefore releases adjusting signals to a paint needle-valve with a specific lead time which is predetermined as a function of robot speed.

Paint is usually supplied to the paint needle-valve through conduit lines communicating with a gear-pump or the like and having a return circuit, i.e., bridge, running from the outlet to the inlet of the pump. The purpose of the return circuit is to ensure that the correct operating pressure is maintained at all times at the pump outlet, even when the pump needle-valve is closed. A constant operating pressure is maintained so that the operating pressure does not have to be built up each time the needle-valve is opened. The prior art return circuits contain a pressure sensitive valve which opens automatically in response to pressure in the paint-lines when the paint needle-valve is closed. This pressure sensitive valve closes automatically as soon as the needle-valve is opened. However, the use of these pressure sensitive valves have led to undesirable pressure fluctuations which affect the accuracy with which the jet spray of paint impinged upon the body being coated. Additionally, pressure sensitive valves controlled by the paint pressure respond differently, depending upon the particular rheological properties (i.e. the flow-behaviors) of the paint used.

SUMMARY OF THE INVENTION AND ADVANTAGES

A control-system for a program-controlled spraying device is provided. The control system comprises at least one fluid conduit line, a pump having a fluid inlet and a fluid outlet for moving fluid through the conduit line, a moveable main valve for automatically switching on and off the fluid flow through the conduit line at predetermined times, a return circuit directing fluid flow from the fluid outlet of the pump to the fluid inlet of the pump, the return circuit including a flow-control valve closed to fluid flow therethrough when the main valve is open and open to fluid flow therethrough when the main valve is closed. The control system is characterized by including an external control unit supplying an adjustable control signal to the control valve at predetermined times, the control signal being responsive to the movement of the main valve.

The subject invention provides a paint flow control-system which ensures accurate control of the jet of paint emerging from the spraying device and, above all, eliminates undesirable pressure-peaks in the paint-feed system.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
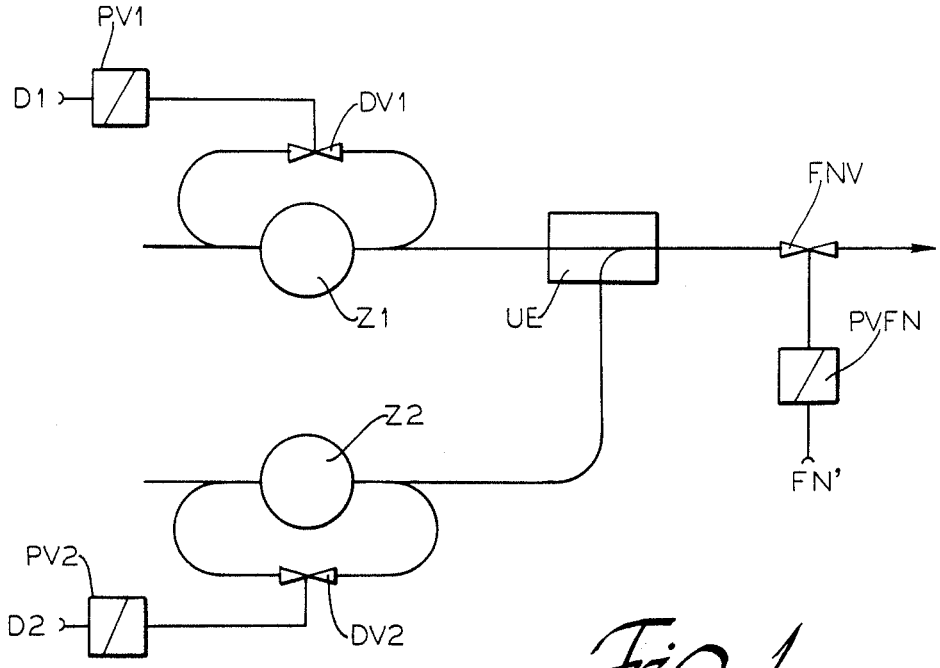
FIG. 1 is a schematic diagram of the paint conduit line system of the subject invention.

As shown in FIG. 1, two parallel conduit supply lines conduct paint to a main valve FNV, more specifically a paint needle-valve FNV, for respectively supplying a different color thereto. A paint changeover unit UE is disposed between the two conduit lines and the paint needle-valve FNV for selectively directing the paint flow from one of the two conduit lines to the paint needle-valve FNV. A gear-pump Z1, Z2 is provided with each conduit line for pumping paint therethrough. When the paint needle-valve FNV is closed, the paint flow is diverted through a return-circuit, or a bridging circuit, provided with each conduit line which is opened and closed by respective flow-control valves DV1, DV2. Even when the paint needle-valve FNV is closed, both gear-pumps Z1, Z2 are constantly operating at a predetermined rate. Depending upon the flow directing position of the paint changeover unit UE, either the flow control valve DV1 or the flow control valve DV2 is closed while the paint needle-valve FNV is open. The paint needle-valve FNV and the two flow-control valves DV1, DV2 are actuated by respective pneumatic valves PVFN, PV1 and PV2 which may, in turn, be controlled by electrical signals.

The following unavoidable delays occur in the above-described system: (1) the time lapse between the electrical switching-on signal for the paint needle-valve FNV and the moment at which the paint needle-valve FNV reaches its open position, which is indicated by an electrical report-back signal FNR actuated by a sensor incorporated into the paint needle-valve FNV, i.e., the time lapse between the switch-on signal and the report-back signal; (2) the time lapse between the electrical switching-off signal for the paint needle-valve FNV and the moment at which the paint needle-valve FNV is actually closed (no report-back signal being provided as it is assumed that either this delay is equal to the switching-on delay of the paint needle-valve FNV or is in a fixed relationship therewith); (3) the time lapse between the electrical switching-on signal for the flow-control valve DV1 and the moment at which the flow control valve DV1 actually opens; (4) the time lapse between the electrical switching-off signal for the flow-control valve DV1 and the moment at which the flow-control valve DV1 closes; (5) the time lapse between the electrical switching-on signal for the flow-control valve DV2 and the moment at which the flow control valve DV2 opens; (6) the time lapse between the electrical switching-off signal for the flow-control valve DV2 and the moment at which the flow-control valve DV2 closes.

Figure 2:
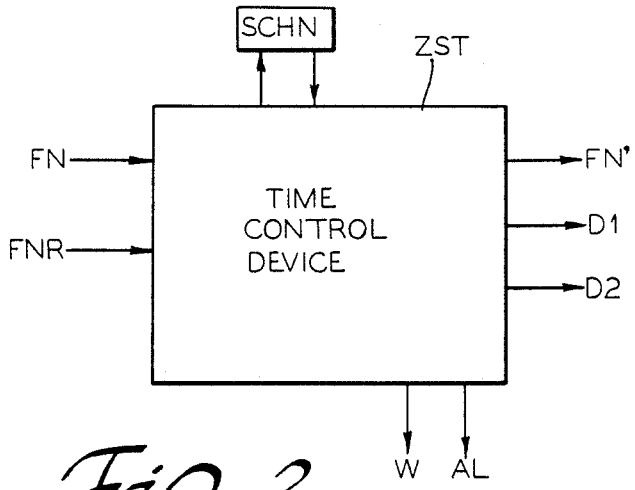
FIG. 2 is a block diagram of a time-control unit according to the subject invention.

These delays are compensated for by a time-control unit ZST shown in block diagram form in FIG. 2. The time-control unit ZST contains a micro-processor which receives binary switching-on and switching-off commands FN for the paint needle-valve FNV from the overriding robot program control. Based upon a switching-on command FN, the time-control unit ZST produces electrical switching signals FN', D1 and D2 for respectively switching open and closed the paint needle-valve FNV and the two flow-control valves DV1 and DV2 on and off. These switching signals control pneumatic valves PVFN, PV1 and PV2 as shown in FIG. 1. A report-back signal FNR, produced by the paint needle-valve FNV upon reaching its open position, is also fed into the time-control unit ZST.

Figure 3:
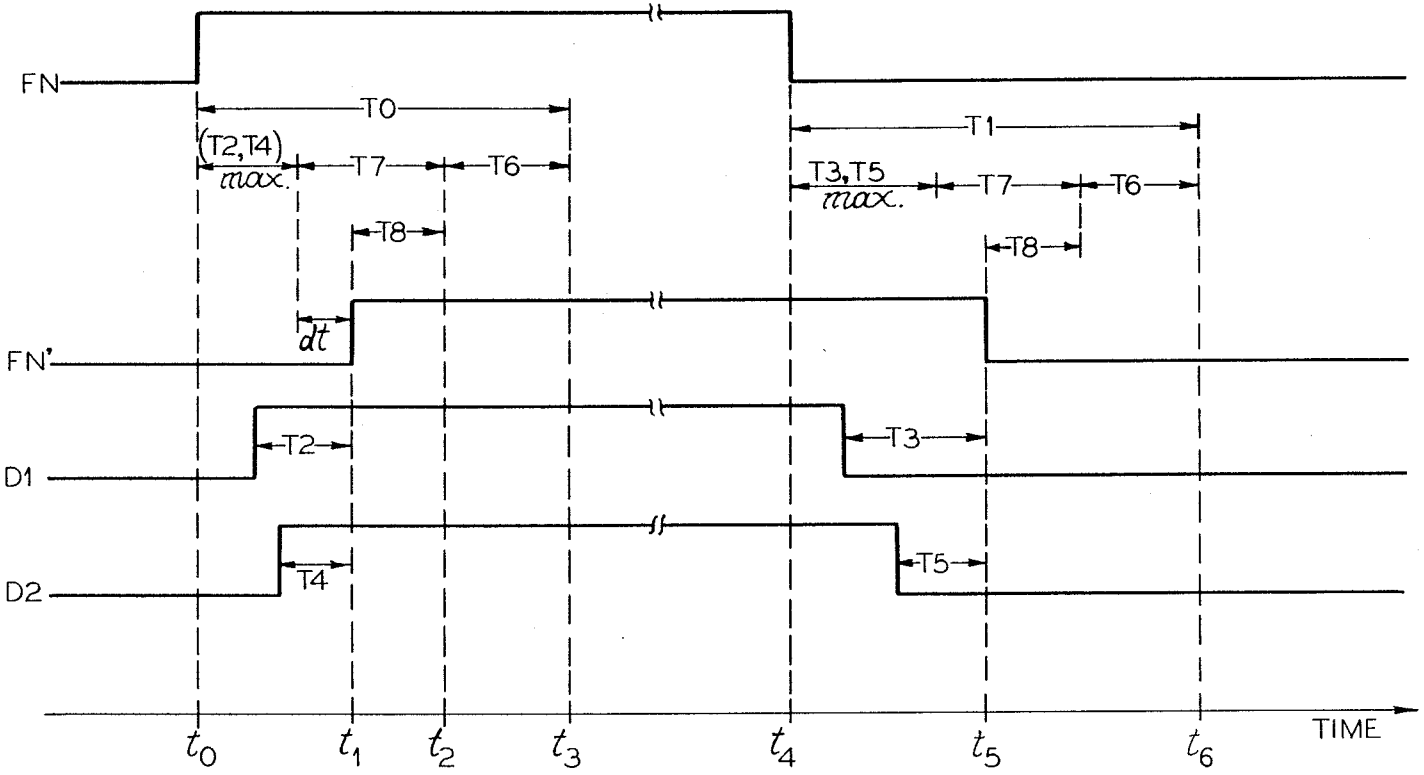
FIG. 3 is a time sequence diagram illustrating the switching times of the time-control unit.

The time durations of the above-described signals are illustrated in FIG. 3. The time-control unit ZST receives, at time $t_0$, from the robot program control a switching-on command FN. Then, after an adjusted waiting period until time $t_1$, the switching-on command FN produces the switching-on signal FN' for the paint needle-valve FNV. According to a measured time T8 defined by the time required for the paint needle-valve FNV to open, the report-back signal FNR is produced by the paint needle-valve FNV at time $t_2$. According to a predetermined paint flight-time T6, the paint contacts the body to be coated at time $t_3$. The total time between $t_0$ and $t_3$ is the switching-on time, or lead-time, T0 of the paint needle-valve FNV provided in the robot program as a process-parameter.

A switching-off time T1 of the paint needle-valve FNV, also required as a process-parameter, is determinable in a way similar to the switching-on time T0. The switching-off time T1 comprises the time lapse between the ceasing of the overriding switching-on command FN at time $t_4$ and the switching signal FN' produced by the time-control unit ZST at time $t_5$, plus the switching-off delay time of the paint needle-valve FNV which is assumed here to be equal to the measured switching-on paint-needle time T8, plus the paint flight-time T6. Thus, the coating of the body comes to an end at time $t_6$.

Also shown in FIG. 3 are the switching-on and switching-off times T2 and T3, respectively, of the flow-control valve DV1. Additionally, the switching-on and the switching-off times T4 and T5, respectively, of the flow-control valve DV2 are shown. The times T2, T3, T4 and T5 illustrate the times during which the flow-control valve switching signals D1 and D2 are produced. These times are adjusted in the time-control unit ZST so as to produce optimal pressure ratios in the paint conduit lines between the respective gear-pumps Z1, Z2 and the paint needle-valve FNV. These times may be determined by appropriate operating tests.

Figure 4:
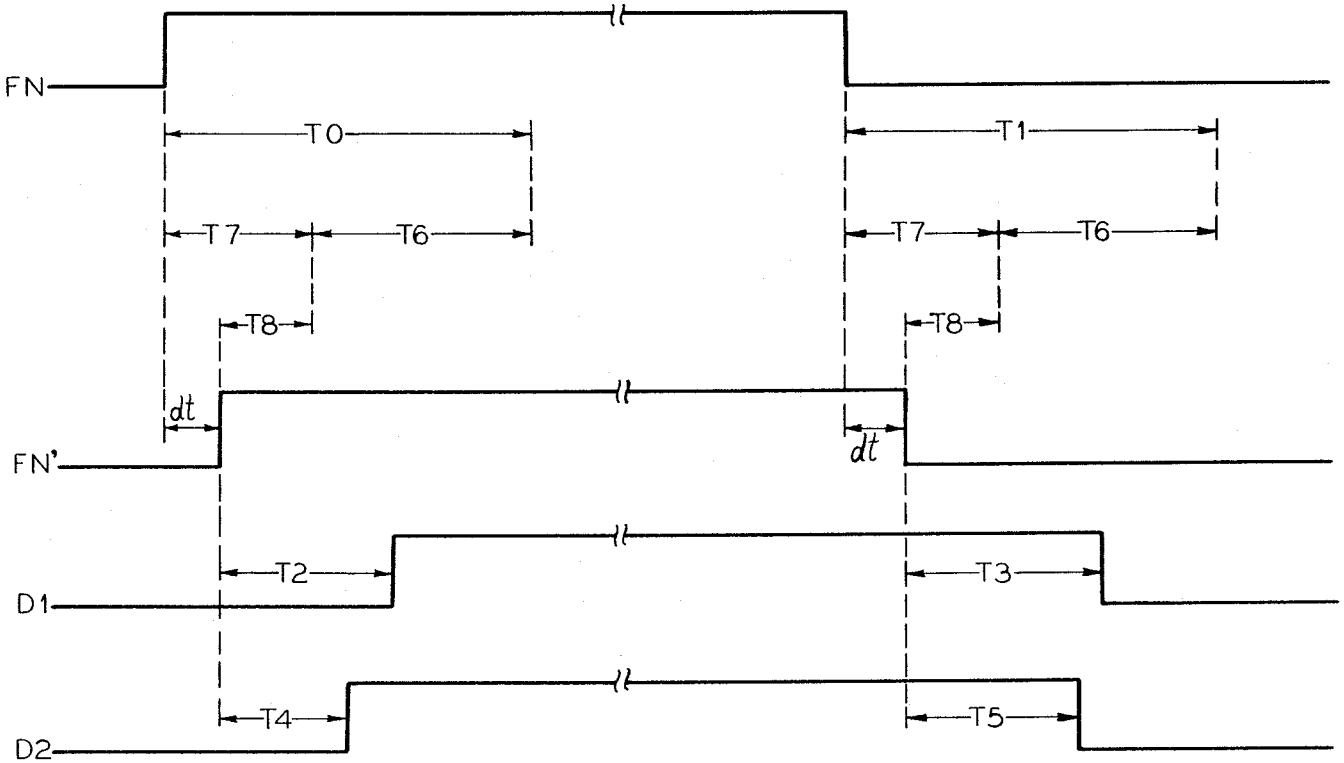
FIG. 4 is a variation of the time sequence diagram of FIG. 3 illustrating yet another type of operation.

In the example illustrated in FIG. 3, the flow-control valve switching times T2, T3, T4 and T5 occur prior to the paint needle-valve FNV switching times. In other cases, and with other valve designs or conduit line conditions, for example, it may be necessary to switch the flow-control valves DV1, DV2 chronologically after the paint needle-valve FNV. This case is shown in FIG. 4 which otherwise corresponds to FIG. 3 and thus needs to further explanation.

A special problem may arise as a result of automatic changes in the actual paint needle-valve FNV opening time T8 due to changes in friction or wear of the moving parts. If the paint needle-valve FNV opening time is shorter or longer than the initial value used in programming the robot and in adjusting the time-control unit ZST, this produces coating defects on the body and also pressure-errors may arise in the conduit line system, because the switching times T2, T3, T4 and T5 of the flow-control valves DV1, DV2, no longer match the actual opening and closing times T8 of the paint needle-valve FNV.

In order to overcome this problem in the system described herein, a theoretically calculated maximum permissible paint needle-valve opening time T7 is determined. The length of the maximum permissible paint needle-valve opening time T7 must not be exceeded by the measured time T8. Under normal operating conditions, the opening time T8 is shorter than the maximum permissible opening time T7. In order to ensure that the paint needle-valve FNV is opened at exactly the proper time $t_2$, the time-control unit ZST switches-on the paint needle-valve FNV at a later time, by a time-interval corresponding to the difference between T7 and T8, than if the theoretical paint needle-valve opening time T7 were only used.

Now if, after a period of use, the measurement of the actual paint needle-valve opening time T8 shows a change from the time T8 originally measured, this change may be compensated for in the time-control unit ZST by automatic adaptation to an interval dt.

If, in the course of time, measured paint needle-valve opening time T8 increases to such an extent that it can no longer be compensated for by reducing dt, i.e., the time-interval dt shifts toward zero or becomes negative and paint needle-valve opening time T8 becomes greater than or equal to T7, the time-control unit ZST will produce an alarm signal AL and simultaneously open the flow-control valves DV1, DV2 and close the paint needle-valve FNV. Before this happens, however, it is possible to produce a warning signal W as soon as the measured value of the paint needle-valve opening time T8 approaches a critical limit.

Rather than comparing the continually measured paint needle-valve opening time T8 in the time-control unit ZST directly with the stored normal value, it may be desirable to obtain an average value from a series of measurements. The warning and alarm signals are produced only if this average value exceeds the critical limit.

The switching-on time $t_1$ should not be before the expiration of a time interval maximum (T2, T4), occurring after time $t_0$ and corresponding to the maximum possible switching-on time T2, T4 of the flow-control valves DV1 and DV2. A time interval maximum (T3, T5) for the switching-off times of the flow-control valves DV1, DV2 is taken into account in selecting the times $t_4$ and $t_5$.

In the case shown in FIG. 4 wherein the flow-control valve DV1, DV2 actuation is after paint needle-valve FNV actuation, the compensating time interval dt can, in the alternative, directly follow the moment at which the switching command FN is produced by the program control. This applies both to switching-on and to switching-off.

The paint needle-valve opening time T8, which may vary, and the time interval dt may be monitored continuously by the operating crew with the aid of a display screen connected to the time-control unit ZST by an interface SCHN. The necessary times may also be adjusted and changed by this interface.

The pressure ratios between the gear-pumps Z1, Z2 and the paint needle-valve FNV are not dependent solely upon correct switching times of the paint needle-valve FNV and the valves in the gear-pump return circuits, but also upon the rheological properties of the fluid fed to the spraying device. In order that the rheological properties may be taken into account, the valves in the return circuits are preferably flow-control valves which, in addition to being switched on and off, may be adjusted by external control signals (in a manner not shown) to the most favorable pressure at the outlet from the feed pump. Measurement of the rheological properties of the fluid also makes it possible to readjust the flow-control valves DV1, DV2 in a closed regulating circuit.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed:

1. A control system for a program-controlled spraying device comprising: at least one fluid conduit line; a pump (Z1, Z2) having a fluid inlet and a fluid outlet for moving fluid through said conduit line; a main valve (FNV) moveable between an open position and a closed position over a variable switching time period for automatically switching on and off the fluid flow through said conduit line at predetermined times; a return circuit directing fluid flow from said fluid outlet of said pump (Z1, Z2) to said fluid inlet of said pump (Z1, Z2), said return circuit including a flow-control valve (DV1, DV2) closed to fluid flow therethrough when said main valve (FNV) is open and open to fluid flow therethrough when said main valve (FNV) is closed; said control system characterized by including an external control unit (ZST) for supplying a control signal (D1, D2) to automatically open and close said control valve (DV1, DV2) at predetermined adjustable times in response to the switching time of said main valve (FNV).

2. A control system as set forth in claim 1, further characterized by said external control unit (ZST) including means for adjusting the fluid flow through said flow-control valve (DV1, DV2) in response to the pressure in said conduit line at said outlet from said pump (Z1, Z2) and in response to the rheological properties of the fluid.

3. A control system as set forth in either of claims 1 or 2, wherein a response-delay time is measured as the duration between the moment said control signal (D1, D2) is supplied to said flow control valve (DV1, DV2) and the moment said flow control valve responds to said control signal (D1, D2), further characterized by said control unit (ZST) including means for automatically altering at least one of said predetermined times of said main valve (FNV) or said flow-control valve (DV1, DV2) as a function of said response-delay times measured while the spraying device is in operation.

4. A control system as set forth in claim 3 further characterized by said valve (FNV) including means for measuring the time duration between the application of a switching signal (FN') to open said main valve (FNV) and the time ($t_2$) at which said main valve responds to said switching signal (FN').

5. A control system as set forth in claim 4 further characterized by said main valve (FNV) including means for producing a report-back signal (FNR) to said control-unit (ZST) when said main valve (FNV) reaches the fully-open position.

6. A control system as set forth in claim 5 further characterized by including pneumatic control-lines having electrically controlled switching valves (PV1, PV2) for controlling said main valve (FNV) and said flow control valve (DV1, DV2).

* * * * *